US012084942B2

(12) United States Patent
Carragher

(10) Patent No.: US 12,084,942 B2
(45) Date of Patent: Sep. 10, 2024

(54) DOWNHOLE WELL TOOLS AND METHODS OF USING SUCH

(71) Applicant: BiSN Tec Ltd., Runcorn (GB)

(72) Inventor: Paul Carragher, Lymm (GB)

(73) Assignee: BisN Tec Ltd., Warrington (GB)

( * ) Notice: Subject to any disclaimer, the term of this patent is extended or adjusted under 35 U.S.C. 154(b) by 0 days.

(21) Appl. No.: 17/216,595

(22) Filed: Mar. 29, 2021

(65) Prior Publication Data

US 2022/0025730 A1 Jan. 27, 2022

Related U.S. Application Data

(63) Continuation of application No. 15/502,960, filed as application No. PCT/GB2015/052348 on Aug. 14, 2015, now Pat. No. 10,961,806.

(30) Foreign Application Priority Data

Aug. 15, 2014 (GB) ..... 1414565
Apr. 2, 2015 (GB) ..... 1505750

(51) Int. Cl.

| | |
|---|---|
| ***E21B 33/13*** | (2006.01) |
| ***E21B 17/042*** | (2006.01) |
| ***E21B 19/00*** | (2006.01) |
| ***E21B 29/10*** | (2006.01) |
| ***E21B 31/00*** | (2006.01) |
| ***E21B 33/12*** | (2006.01) |
| ***E21B 33/122*** | (2006.01) |
| ***E21B 33/124*** | (2006.01) |
| ***E21B 33/14*** | (2006.01) |
| ***E21B 36/00*** | (2006.01) |
| ***E21B 43/10*** | (2006.01) |

(52) U.S. Cl.

CPC ..... *E21B 33/122* (2013.01); *E21B 17/042* (2013.01); *E21B 19/00* (2013.01); *E21B 29/10* (2013.01); *E21B 31/007* (2013.01); *E21B 33/1208* (2013.01); *E21B 33/124* (2013.01); *E21B 33/13* (2013.01); *E21B 33/14* (2013.01); *E21B 36/008* (2013.01); *E21B 43/10* (2013.01)

(58) Field of Classification Search

CPC ..... E21B 33/122; E21B 17/042; E21B 19/00; E21B 31/007; E21B 33/1208; E21B 33/124; E21B 33/13; E21B 33/14; E21B 36/008; E21B 41/00; E21B 43/10

See application file for complete search history.

(56) References Cited

U.S. PATENT DOCUMENTS

| | | | | |
|---|---|---|---|---|
| 6,474,414 | B1 * | 11/2002 | Gonzalez | E21B 33/14 166/57 |
| 2004/0108112 | A1 * | 6/2004 | Nguyen | E21B 33/138 166/295 |
| 2004/0149418 | A1 * | 8/2004 | Bosma | E21B 29/10 164/98 |
| 2005/0217860 | A1 * | 10/2005 | Mack | E21B 43/128 166/387 |

(Continued)

*Primary Examiner* — Taras P Bemko

(57) ABSTRACT

A downhole tool for use in a gas or oil well is provided. The tool comprising a length of tubing having at least one annular sealing means mounted on the outer surface thereof. The annular sealing means, which are formed from a eutectic/bismuth based alloy, serve to secure the downhole tool in position within an oil or gas well during so that the tool can carry out its function.

7 Claims, 7 Drawing Sheets

(56) References Cited

U.S. PATENT DOCUMENTS

| | | | | |
|---|---|---|---|---|
| 2012/0132438 | A1* | 5/2012 | Telfer | E21B 23/04 166/321 |
| 2013/0087335 | A1* | 4/2013 | Carragher | E21B 36/00 166/57 |
| 2013/0277053 | A1* | 10/2013 | Yeh | E21B 34/14 166/278 |

* cited by examiner

DOWNHOLE WELL TOOLS AND METHODS OF USING SUCH

This application is a continuation of U.S. patent application Ser. No. 15/502,960, which application is a 371 national stage entry of PCT/GB2015/052348 filed Aug. 14, 2015, which claims the benefit of GB 1414565.0 filed Aug. 15, 2014 and GB 1505750.8 filed Apr. 2, 2015, the entire disclosure of each of which is incorporated by reference.

FIELD OF THE INVENTION

The present invention relates to downhole well tools suitable for use in a variety of operations within oil and gas wells.

BACKGROUND OF THE INVENTION

In order to access oil and gas deposits located in underground formations it is necessary to drill bore holes into these underground formation and deploy production tubing to facilitate the extraction of the oil and gas deposits.

Additional tubing, in the form of well lining or well casing, may also deployed in locations where the underground formation is unstable and needs to held back to maintain the integrity of the oil/gas well.

During the formation and completion of an oil/gas well it is crucial to seal the annular space created between the casing and the surrounding formation. Also the annular space between the different sizes casings used as the well is completed. Additionally the annular space between the production tubing and said casing needs to be sealed. Further seals may be required between the underground formation and the additional tubing.

One of the most common approaches to sealing oil/gas wells is to pump cement into the annular spaces around the casing. The cement hardens to provide a seal which helps ensure that the casing provides the only access to the underground oil and gas deposits. This is crucial for both the efficient operation of the well and controlling any undesirable leakage from the well during or after the well is operated.

Eventually, once the necessary tubing is secured within an oil or gas well, the operation of a well can commence and extraction can begin. Over the operational lifetime of an oil/gas well situations can arise where it is necessary to deploy downhole tools into the tubing.

One common task is the carrying out of repairs to the tubing, which due to the downhole environment can develop fractures/leaks over time. Another common task is to isolate (whether temporary or semi-permanent) a region of a well from the rest of the production tubing.

Various downhole tools are employed in such situations, with some of the most commonly used including bridge plugs, patches, scab and straddles. In order to secure the downhole tool within a well such tools are typically provided with hydraulically actuated means that can be operated to engage with the surface of a surrounding tubing (e.g. a well casing, liner or production tubing).

A plurality of these engagement means, which are commonly referred to as 'dogs' or 'slips', are normally provided on a downhole tool so that once the tool is in place they can be actuated to lock the tool in position relative to the surrounding tubing.

Once the required task has been completed by the downhole tool the 'dogs' or 'slips' can be retracted and the tool can be retrieved from the well.

Although the 'dogs' or 'slips' are suitable to retain the position of a downhole tool within a well they are not capable of providing a gas tight seal with the surrounding tubing. In view of this, on occasions where a gas tight seal is desirable the downhole tool is provided with additional sealing means. This can increase the possibility for a malfunction of the downhole tool.

Some types of downhole tools, such as expandable patches, are secured in position by expanding the main body of the downhole tool so that it pushes against the inner surface of the outer tubing.

SUMMARY OF THE INVENTION

The present invention seeks to utilise alternative means for securely positioning downhole tools within oil or gas wells that provide a viable alternative to the systems (such as hydraulically actuated means; e.g. 'dogs', 'slips') commonly used in existing downhole tools.

To this end the present invention employs the use of eutectic/bismuth based alloy annular packers described hereinafter as an alternative means for temporarily or permanently securing a downhole tool within an oil or gas well.

The annular packers described throughout essentially consist of a reservoir of eutectic/bismuth based alloy that is mounted on the outer surface of a section of tubing. The alloy can be melted to form a seal between the outer surface of the tubing and the inner surface of surrounding tubing.

It is appreciated that the seal formed can be used to not only provide a gas tight seal but also secure the inner tubing in position within the outer tubing. In view of this and to avoid any confusion the annular packers that are used in the downhole tools of the present invention can also be referred to as annular seals or annular sealing means. The terms 'annular packer', 'annular sealing means' and 'annular seal' are therefore considered to be interchangeable when used in connection the downhole tools of the present invention.

The general concept of the annular packers, which are described herein for information purposes only, are the subject a separate patent application.

In order to aid the description of the downhole tools of the present invention a gas or oil well tubing having an annular packer mounted thereon, wherein the annular packer is formed from a eutectic or other bismuth based alloy, is described.

In its broadest sense the tubing may refer to a section of welling lining, a section of well casing or a section of production tubing.

Mounting the annular packer on the tubing that is then deployed in the formation of an oil/gas well means that the alloy is already in situ within the well. In this way, when a leak is detected it can be remedied by simply heating the region of the tubing where the annular packer is mounted.

It is appreciated that, in use, the tubing could be effectively deployed just above the cement seal so that when melted the alloy of the annular packer can quickly and easily flow into any cracks/gaps formed in the cement.

Alternatively the tubing could be completely surrounded by and embedded within the cement.

It is also envisioned that the tubing might effectively be deployed well above the cement seal or even in wells that do not contain a cement seal.

In those cases where a cement seal is employed it is envisioned that whilst the tubing of the first aspect of the present invention may be deployed after the cement seal has been formed, it is considered more likely that the tubing may be deployed within a well bore before the cement seal has been formed.

To this end the annular packer may preferably be provided with one or more conduits running substantially parallel to the tubing. The conduits facilitate the passage of cement beyond the annular packer when it is poured or pumped into the annular space to form the aforementioned seal.

The conduits may be provided as channels in the inner and/or outer circumferential surface of the annular packer. Alternatively the conduits may be provided as through holes in the main body of the annular packer.

In order for the packer to create a gas tight seal it is necessary to remove the cement from any conduits. This can be achieved by squeezed the cement out while the cement is still in liquid form. Alternatively the cement in the conduits can be broken once it has solidified.

In one variant the annular packer may be mounted on the inner surface of the tubing. It is envisioned that this arrangement is particularly suitable when the tubing is a well casing or well lining.

In an alternative variant the annular packer may be mounted to the outer surface of the tubing.

Preferably, the annular packer may comprise multiple component parts which are combinable to form the complete annulus when mounted on the tubing. In this way the production step of mounting the annular packer on the tubing is made quicker and easier.

Further preferably the multiple component parts may consist of two or more ring segments which can be connected together to form a complete annular packer that encircles the tubing.

This external mounting arrangement is considered particularly suitable when the tubing is production tubing. However, as will now be explained, the inventors have conceived a number of related applications made possible by locating an alloy annular packer or annular seal on the outer surface of the tubing.

In a first aspect, the present invention provides a downhole tool comprising tubing with at least one annular sealing means mounted on an outer surface thereof, wherein the annular sealing means is formed from a eutectic/bismuth based alloy.

The provision of at least one annular sealing means on the outer surface of the tubing enables the formation of an annular seal between the outer surface of the tool and the inner surface of a surrounding well tubing/casing. It is appreciated that the ability to set and unset the annular seal with a heater deployed within the well facilitates the easy deployment and removal of these downhole tools, which are normally, although not always, only required for a limited period of time.

Preferably in addition to said one or more annular sealing means, which are used to secure the downhole tool in position, the downhole tool may be provided with a separate region of eutectic/bismuth based alloy that is distinct from the annular sealing means.

It is envisaged that the additional alloy region can be heated in a separate operation (possibly once the downhole tool has been set in position) in order to carry out a patch repair of a leak in the surrounding well casing. In this way the downhole tool can be employed as a patch.

Alternatively or additionally the tubing may further comprise tool engagement means located within the tubing. Providing tool engagement means within tubing before it is deployed with an oil/gas well enables the subsequent deployment and secure mounting of operational tools (e.g. such as valves and flow rate monitors) within the well.

It is also envisaged that the tool engagement means might also be used by any heater tool used to melt the eutectic/bismuth based annular packer/annular sealing means.

It is further envisioned that the tool engagement means might also be used to securely retain a temporary plug, the interior of the tube could be fitted with an easy to break section (.e.g. a burst disc) which allows the well to be opened up again with reduced operation costs The tool could be set either in situ down the well or prefabricated prior to deployment down the well.

Further preferably the tool engagement means are located on the inner surface of the tubing that is proximate to the externally mounted annular packer. Alternatively the tubing may be provided with magnetic heater alignment means that enable a sensor on the heater to detect when it is correctly aligned with the tubing's externally mounted annular seal(s).

In order to enable the downhole tool to be delivered down the well the tool is preferably provided with attachment means for connecting the tool to a delivery tool, for example by way of a wire line or a setting tool. Further preferably the attachment means comprise shear pins so that the wire line can be retrieved from the well once the downhole tool has been secured in position by the annular sealing means.

Preferably the tubing may also have a weak point just above the 'slump' line 20 of the set alloy. In this way the tool length can be reduced after setting, which reduces the operational costs if the tool needs to be removed in future, e.g. by milling.

Preferably the tubing is formed from two sections that are held together, at least in part, by a eutectic/bismuth based alloy. Further preferably the attachment means for connecting the downhole tool to the delivery tool (e.g. via a wire line) can be located on the section of the tubing that is released/revealed when the alloy sags.

In this way a section of the tubing can be retrieved from the well. This is considered particularly advantageous because it reduces the amount of material that needs to be removed from the well in the event that milling or drilling is used.

Further preferably the section of the tubing that remains in the well may be formed from a softer material (e.g. aluminium) than the section with the delivery tool attachment means. In this way any subsequent milling/drilling out of the downhole tool is made easier/quicker.

Preferably the section of the tubing that remains in the well may have walls that are thinner that at least a portion of the section with the delivery tool attachment means. Once again this will facilitate easier milling/drilling out of the downhole tool.

It is appreciated that varying the length of the tubing can provide a variety of downhole tools that range from patches, which have a shorter length of tubing, to straddles, which have a considerably longer length of tubing, and scabs, which can be have length of tubing that is somewhere in between. These various types of downhole tool are all considered to fall within the scope of the present invention.

It is appreciated that the size, number and positioning of the eutectic/bismuth based alloy annular sealing means provided on the outer surface of the tubing will vary from tool to tool. For example it is considered appropriate that the size (and possibly the number) of the annular sealing means used on a straddle would be greater than required for a patch due to the much greater weight load being carried by the annular seals formed between the outer well tubing and the downhole tool.

It is envisioned that an appropriately dimensioned tubing with the tool engagement means and an annular sealing means could be deployed within an existing oil/gas well and secured in place using the alloy to temporarily install a control tool(such as a valve), a measuring tool(e.g. flow rate) or even a breakable plug at a target location.

To this end a second aspect of the present invention relates to a well tool deployment adaptor comprising the tubing of the first aspect of the present invention, wherein the annular sealing means is mounted on the outer surface of the tubing and tool engagement means are located within the tubing.

In the third aspect of the present invention there is provided a breakable eutectic/bismuth based alloy well plug, said plug comprising: an open-ended tubular plug body having eutectic/bismuth base alloy mounted on the outside thereof; and wherein passage through the tubular plug body is blocked by a breakable plugging member.

Preferably the breakable plugging member is provided in the form of a burst disc.

The present invention also provides a method of manufacturing the downhole tool of the present invention, which in turn can be further adapted for use in various embodiments thereof.

Specifically the present invention provides a method of manufacturing a downhole tool for use in oil and gas wells, said method comprising: providing a length of tubing; mounting at least eutectic/bismuth based alloy annular sealing means to an outer surface of the tubing.

Preferably the annular sealing means is provided in the form of multiple component parts and the step of mounting the annular sealing means to the tubing involves securing the component parts together around the circumference of the tubing to complete the annulus. This approach is considered most appropriate for producing the variants of the tubing according to the present invention that has the annular sealing means mounted on the outer surface thereof.

Preferably the method of manufacturing the oil/gas well tubing further comprises providing multiple conduits in the annular sealing means. As detailed above, the conduits may be in the form of channels in the inner and outer surface of the annular sealing means. Alternatively the conduits may possibly be in the form of through holes running through the main body of the alloy.

The present invention also provides a method of sealing a leak in a completed oil/gas well using the downhole tool of the present invention by heating the annular sealing means in situ to melt the alloy and seal the leak.

Preferably a heating tool, such as a chemical heater, can be deployed down the well to apply heat to the eutectic/bismuth based annular sealing means and cause it to melt. Alternatively the tubing may further comprise heating means that can be activated remotely to melt the alloy. In such an arrangement the heating means are preferably in the form of a chemical heat source.

Preferably the method involves the step of removing the downhole tool once the leak in the tubing has been sealed with alloy. Further preferably the downhole tool is removed by milling/drilling. This approach is considered particularly beneficial because it enables the tubing to be returned to its original operational diameter, which is in contrast to other patch operations wherein the patch is left in situ to cover the leak.

BRIEF DESCRIPTION OF THE DRAWINGS

The various aspects of the present invention will now be described with reference to the drawings, wherein.

DETAILED DESCRIPTION OF THE VARIOUS ASPECTS OF THE PRESENT INVENTION

The various aspects will now be described with reference to the Figures, which provide a collection of diagrammatic representations of embodiments of the each aspect of the present invention to aid the explanation of their key features.

One of the central features of a number of the aspects of the present invention is formation of prefabricated oil/gas tubing with a eutectic/bismuth based alloy annular packer mounted to the said tubing. Although the term annular packer is used it is appreciated that the terms annular sealing means, annular seal and thermally deformable annulus packer may also employed depending on the context of the embodiment being described. The terms can therefore be used interchangeably.

The term prefabricated is intended to cover situations where the annular packer/annular sealing means is mounted on the tubing either in a factory or on site, but always before the tubing is deployed down a well bore. This is clearly distinct from existing uses of alloy as a sealant, wherein the alloy is deployed separately from the tubing at a later stage—which is usually after completion of the well.

It will be appreciated that, unless otherwise specified, the materials used to manufacture the components of the various apparatus described hereinafter will be of a conventional nature in the field of oil/gas well production.

The downhole tools of the present invention utilise alloy annular packers or annular sealing means rather than more traditional mechanical means (e.g. 'dogs' or 'slips') to retain the tools in position within a well. In order to better understand the annular packers upon which the annular sealing means present invention is based such will now be described with reference to FIGS. 1-4.

Figure 2:
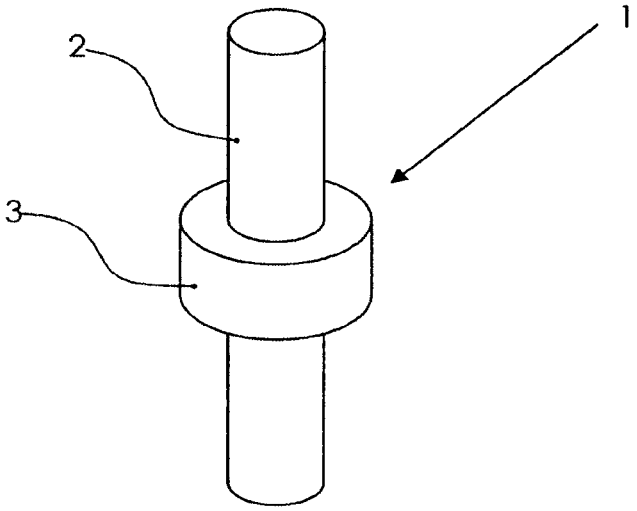
FIG. 2 shows a perspective view of an annular packer being used as a annular sealing means mounted on the outer surface of tubing which can form the basis for a downhole tool in accordance with the present invention.

FIG. 2 shows an oil/gas well tubing 1 suitable for use with the downhole tools of the present invention in the form of a length/section of pipe 2 with a eutectic/bismuth based alloy annular packer 3 mounted on the outside thereof.

Although not shown in the Figures it is envisioned that the externally mounted annular packer might preferably be formed from multiple component parts that combine to surround the length of production pipe 2 so that the process of mounting (and possibly remounting) the annular packer is made easier.

Figure 1:
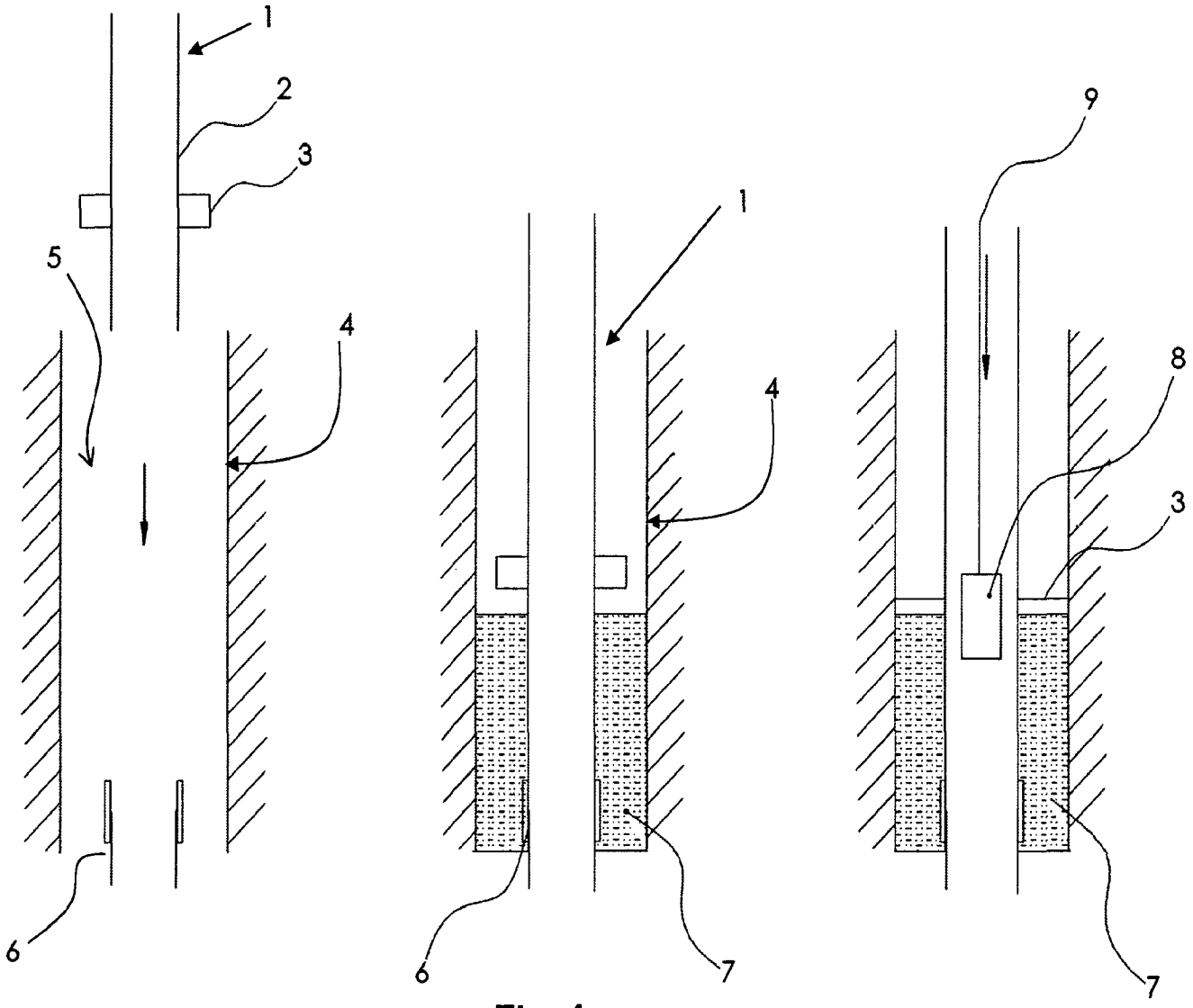
FIG. 1 is a diagrammatic representation of the key stages of the deployment and operation of the oil/gas well tubing of an embodiment of the first aspect of the present invention.

As will be appreciated from FIG. 1 the diameter of the annular packer 3 is sufficient to provide a close fit with the outer wall of the well 5, which may be provided by a rock formation 4 or as appropriate a well casing or lining.

In order to explain the use of the tubing 1 reference is made to FIG. 1, which shows three key stages in the working life of the tubing 1. In the first stage the tubing 1, which comprises the section of tubing 2 with the annular packer 3 mounted on the outer surface, is attached to tubing 6 and delivered down the well bore 5 that has been created in the underground formation 4 using conventional means.

It is appreciated that tubing 1 and 6 are typically connected together above ground and then deployed down the well. However in order to clearly illustrate that tubing 1 and 6 are initially distinct they are initially shown in FIG. 1 as being separate.

In the reference Figures the tubing 1 is attached to the top of the tubing 6 that is already secured in the well 5. It is envisioned that advantageously the tubing 1 of the present invention may be connected to existing production tubing 6 using a collar joint, for example.

Once the production pipework, which comprises tubing 1 and 6, has been deployed within the well 5 cement 7 can be poured or pumped into the annular space between the formation 4 and the pipework (or, if appropriate, between a well casing/lining and the pipework). Once set the cement 7 will seal the well 5 so that the only access to the oil/gas deposit is via the production tubing 1, 6.

In the event that a crack or gap develops in the cement seal and forms a leak a heater 8 can be deployed down the well using a wire line 9 or coil tubing, for example, to a target region inside the tubing 1 that is proximate to the eutectic/bismuth based alloy annular packer 3. Once in place the heater 9 can be activated to melt the alloy 3, which causes it to turn into a liquid and flow into the cracks/gaps in the cement plug 7.

When the alloy 3 of the annular packer cools it expands and plugs the cracks/gaps and reseals the cement plug 7 and stops the leak.

It is appreciated that various annular spaces are created during the formation of a well and it is envisioned that the present invention can therefore be usefully employed in variety of different arrangements without departing from the scope of the present invention.

In the referenced Figures the cement is poured (or pumped) into the annular space after the tubing 1, with its annular packer 3, has been deployed within the well.

In arrangements where the diameter of the annular packer 3 is close to the internal diameter of the rock formation 4 (or well casing/lining—not shown) it is considered advantageous to provide the annular packer 3 with conduits to facilitate the passage of cement through and around the annular packer 3 so that it can reach the lower regions of the well 5.

Figure 1A:
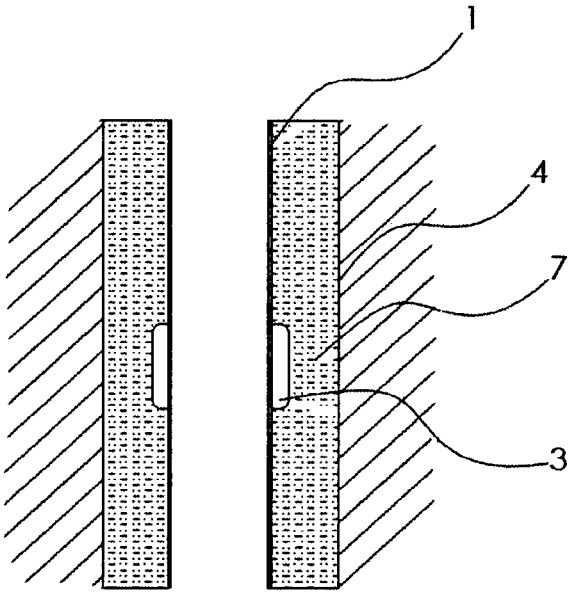
FIG. 1*a* is a diagrammatic representation of an alternative deployment of the tubing with an annular packer.
Figure 1B:
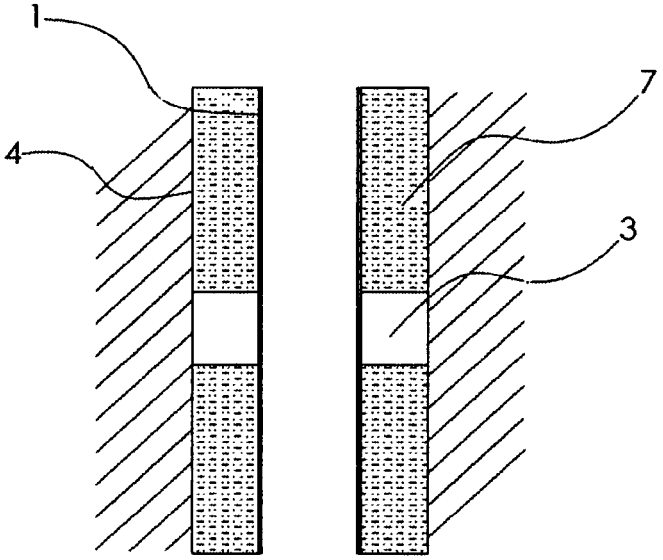
FIG. 1*b* is a diagrammatic representation of a second alternative deployment of the tubing with an annular packer.

It is envisioned that rather than being deployed above the level of the cement the tubing 1 may also be completely surrounded by and embedded within the cement 7. FIGS. 1*a* and 1*b* show such arrangements.

The embodiment of the tubing shown in FIG. 1*a* has an annular packer 3 of a reduced diameter that does not extend all the way to the outer formation (or casing). In is envisioned that such embodiment is suitable for sealing micro annuli leaks; such as those formed by constant expansion and contraction of the production tubing (see above).

The embodiment shown in FIG. 1*b* has an annular packer 3 with a diameter that extends to the surrounding formation (or casing). It is envisioned that this embodiment is more suitable for repairing cracks that extend across the entire cement seal.

Figure 3:
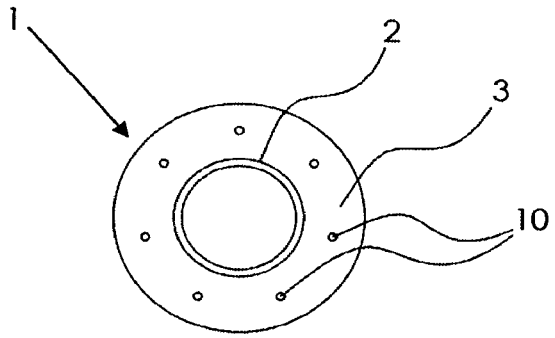
FIG. 3 shows an end view of one variant of the annular sealing means shown in FIG. 2.

FIG. 3 shows a first variant of the annular packer 3, which is provided with a plurality of through holes 10, that could be employed as an annular sealing means in the downhole tools of the present invention. The through holes 10 are arranged to permit the passage of wet cement through the main body of the annular packer 3.

Figure 4:
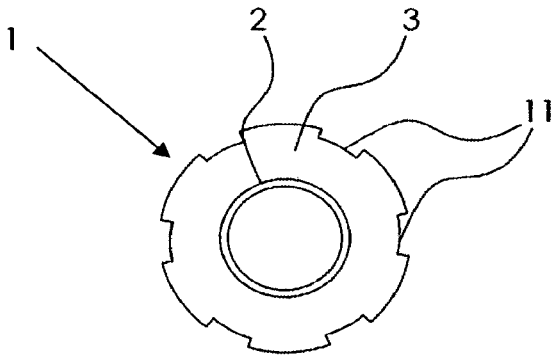
FIG. 4 shows an end view of a second variant of the annular sealing means shown in FIG. 2.

FIG. 4 shows a second variant of the annular packer 3, which is provided with a plurality of channels 11 in the outer surface of the annular packer 3. It is envisaged that both variants might be employed as annular sealing means in the downhole tools of the present invention, however the provision of conduits is not considered crucial to the operation of the downhole tools.

Figure 5:
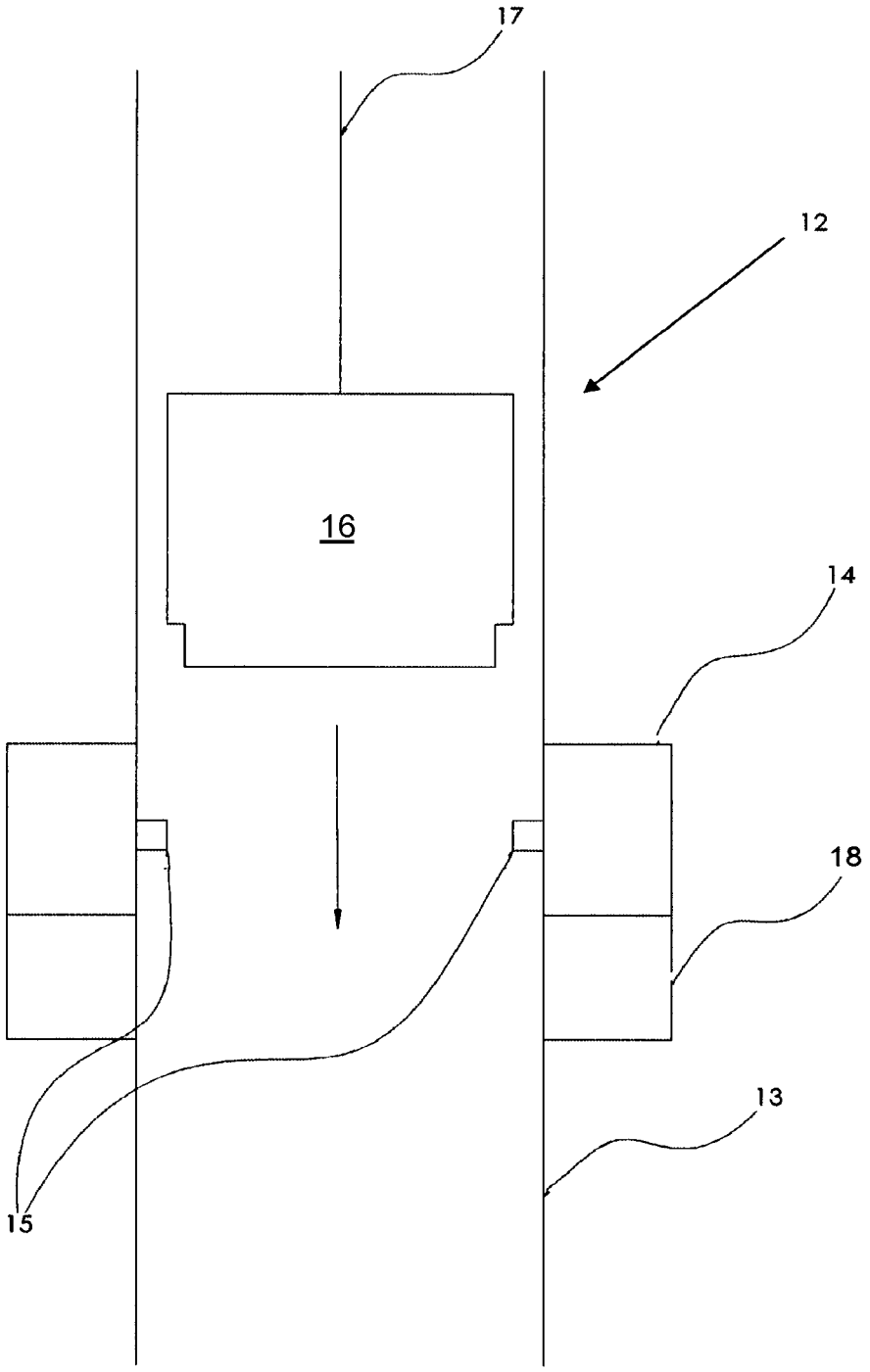
FIG. 5 shows a diagrammatic cross-sectional representation of a well tool deployment adaptor according to the second aspect of the present invention.

Turning now to FIG. 5, in which is shown an embodiment of a downhole tool of the present invention in the form of a well tool deployment adaptor 12 according to a second aspect of the present invention. It will be appreciated that the main components of the adaptor 12 are essentially the same as the tubing shown in FIGS. 1-4, in that it comprises a length/section of tubing 13 with a eutectic/bismuth based annular packer 14 mounted on the outside thereof.

However the adaptor 12 further comprises tool engaging means 15 located inside the adaptor. The tool engaging means 15 can be of any form provided they are capable of securely engaging/locating a complementary tool within the tubing 13.

In use the adaptor 12 is deployed within an existing well tubing structure (e.g. production tubing) and is maintained in place by heating the region of the adaptor proximate to the eutectic/bismuth based alloy and then allowing the alloy cool and fix the adaptor in place within the well by the force of the expanded alloy pressing against the existing well tubing (not shown).

The adaptor is provided with a skirt or 'cool area' 18 to slow the flow of the melted alloy 14 so that it is not lost down the well but instead cools in the target region. Further details of suitable skirting can be found in International PCT Application No. WO2011/151271. It is appreciated that the well fluids will act to quickly cool the heated alloy ensuring that it is not is a flowing state for very long.

Although not shown, it is envisaged that the skirt may further comprise a swellable or intumescent material that is caused to expand when exposed to heat. This further enhances the ability of the skirt to check the flow of the molten alloy so that it can cool in the target region.

Once the adaptor is secured in place within the well a complementary tool 16 (examples of which include a valve, a flow rate meter or even a temporary, breakable plug) can be delivered down the well using delivery means 17 (e.g. wire line).

When the time comes to remove the adaptor 12 a heater can be deployed down the well to engage with the tool engaging means 15, heat the alloy and retrieve the adaptor 12.

Figure 5A:
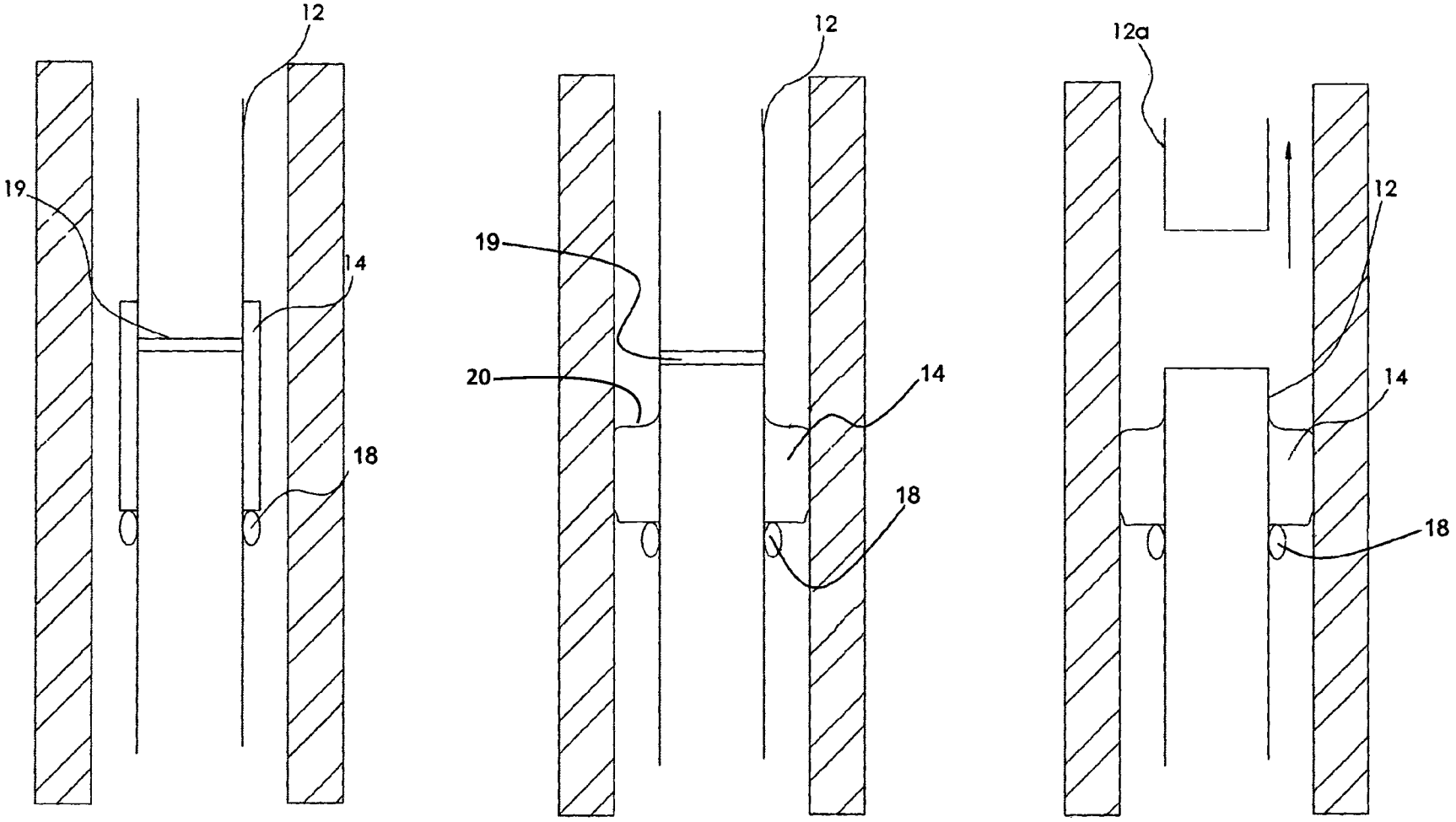
FIG. 5*a* shows a diagrammatic representation of the key stages of the deployment and operation of a further enhanced embodiment of the second aspect of the present invention.

FIG. 5*a* shows a preferred embodiment of the adaptor 12 with the tool engagement means hidden to simplify the diagram. The tubular body of the adaptor is provided with a weakened point 19. During deployment of the adaptor 12 the weakened point is covered by alloy, this gives additional structural support to the adaptor.

Once in situ, and the alloy has been melted to secure the adaptor in place, the weakened point 19 is revealed by the alloy 14. This enables the top portion 12*a* of the adaptor 12 to be broken off and removed. The removal of the top portion 12*a* makes any subsequent operations to remove the adaptor 12 easier due to the reduced amount of tubing that needs to be milled out.

It is appreciated that the technical benefit achieved by providing the weakened point in the adaptor tubing could also be utilised in other aspects of the present invention—such as the breakable eutectic/bismuth based alloy plug according to the third aspect of the present invention, for example.

Another embodiment of a downhole tool of the present invention in the form of a straddle 171 will now be described with reference to FIG. 6, which show the key stages of a straddle deployment operation.

The straddle 171 is configured to be deployable within a well tubing 170 (e.g. a well casing, well lining or other production tubing). The straddle 171, which essentially comprises a length of tubing, is provided with two eutectic/bismuth based annular sealing means 172, 173.

The annular sealing means 172, 173 are located at the leading and trailing end regions of the straddle. However it is envisaged that additional annular sealing means may be provided at points along the length of the straddle's outer surface as required (i.e. when the straddle is of an extended length.

Once the straddle reaches the target region within the well a heater 174 can be operated to heat the annular sealing means so that annular seals can be formed between the outer surface of the straddle 171 and the inner surface of the outer tubing 170.

Figure 6:
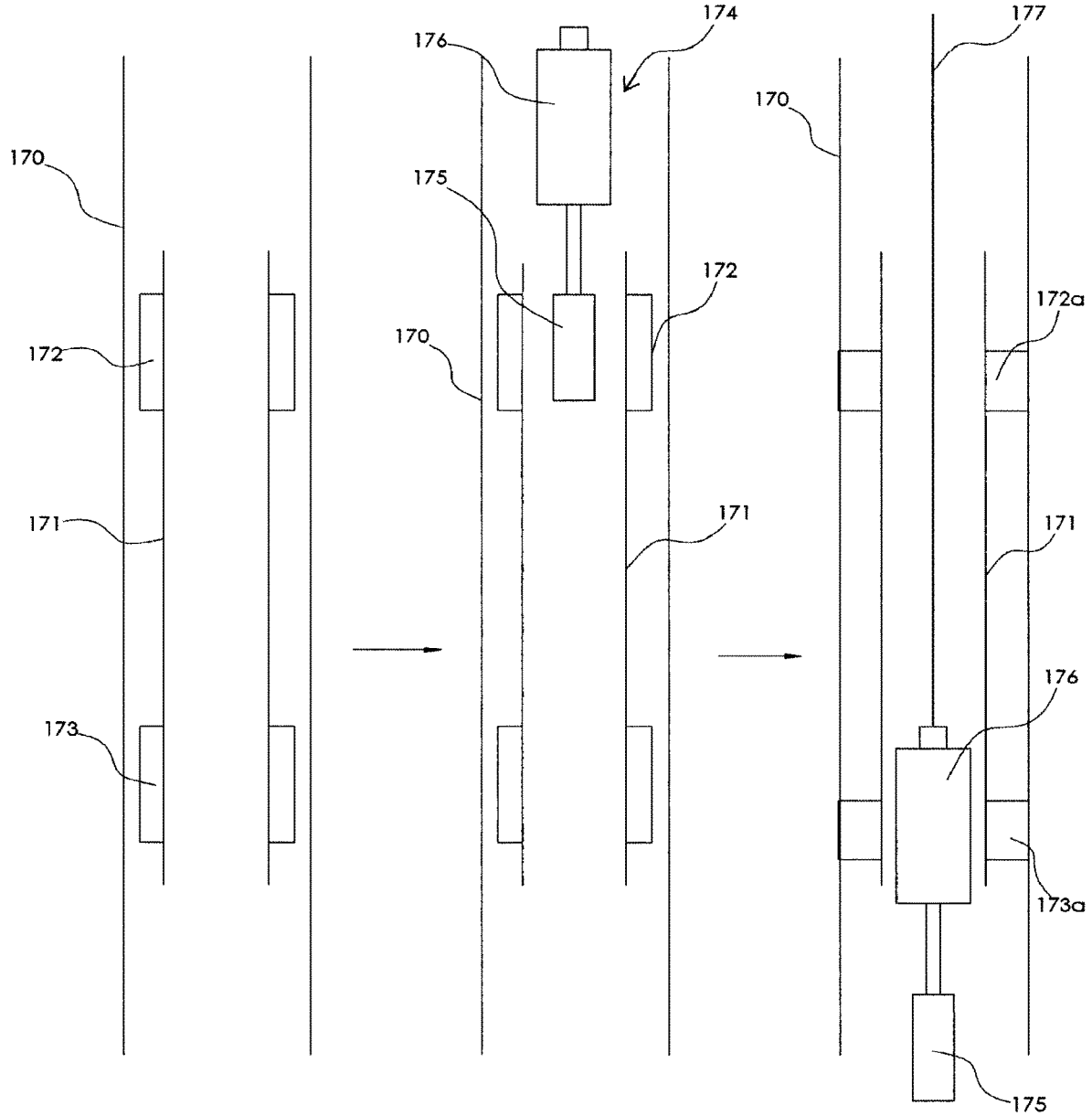
FIG. 6 shows a diagrammatic cross-sectional representation of the key stages of the deployment of a straddle downhole tool according to the present invention.

In FIG. 6 the embodiment shown has uses a heater that has two separate heating modules 175, 176. In this way the straddle can be deployed by the heater in a single deployment (i.e. without having to retrieve the heater from the well and recharge the heat source. It is envisaged that the heating modules are preferably chemical heat sources, although it is appreciated that alternative heat sources could also be employed without departing from the scope of the present invention.

Once the first heating module 175 is aligned with the annular sealing means 172 located at the trailing end of the straddle 171 the heat is activated and the alloy of the annular sealing means 172 is melted and allowed to sag. As the alloy sags and cools an annular seal is formed between the straddle 171 and the outer tubing 170.

Figure 7:
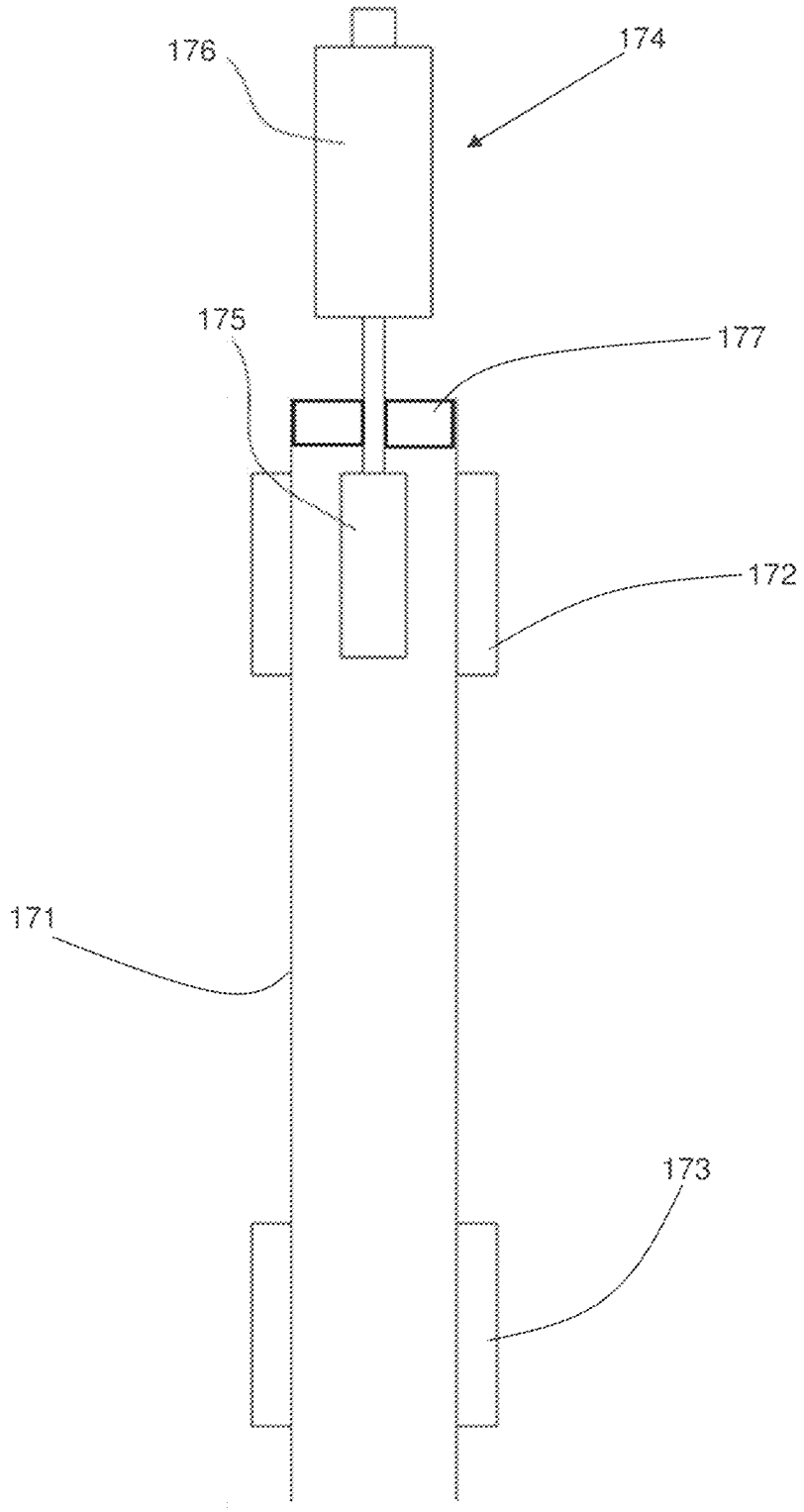
FIG. 7 shows a diagrammatic cross-sectional representation of the downhole straddle tool deployment assembly of the present invention.

As shown in FIG. 7, it is envisioned that the heater 174 and the straddle are preferably attached together by connection means 177 so that they can be deployed down the well as a single unit (i.e., a downhole straddle tool deployment assembly) in which the first heating module 175 is aligned with the annular sealing means 172.

Once the first heating module 175 has finished and the upper annular seal 172*a* has been formed, and the straddle is secured in position in the well, the heater 174 can be detached from the straddle 171 by partially retrieving the heater using the wire line.

Once the heater has been released from the straddle it can be deployed further down the well via the internal cavity of the straddle 171. As will be appreciated although the heater 174 can be delivered using standard delivery means such as a wire line, alternative systems can be used without departing from the present invention.

Once the second heating module 176 is aligned with lower annular sealing means 173 the heating module can be activated and the process of forming an annular seal is repeated at the lower end of the straddle to form the annular seal 173*a*.

Once the second annular seal 173*a* has been set the heater 174 is retrieved from the well using the wire line, for example.

Although the straddle shown in FIG. 6 is provided with two annular sealing means it is envisioned that additional annular sealing means may be provided on the outer surface thereof. It is further envisioned that the heater used to deploy such straddles would advantageous be provided with a corresponding number of heater modules so that the straddle can be fully deployed by the heater in a single visit.

The invention claimed is:

1. A downhole straddle tool deployment assembly, said assembly comprising:

a downhole straddle tool comprising:

a length of tubing having an inner surface defining an internal cavity for fluid flow and having a first annular sealing means on an outer surface of said tubing at a leading end thereof;

a second annular sealing means mounted on said outer surface of said tubing at a trailing end thereof; and wherein said first and second annular sealing means are formed from a eutectic/bismuth based alloy that expands as it cools from a molten liquid state, such that, the alloy of each annular sealing means is melted to form a seal between said outer surface of said tubing and an inner surface of a surrounding gas or oil well tubing;

a heater having at least two separate heating modules, said heating modules being located at the leading end and the trailing end of the heater respectively; and wherein the heater is detachably mounted to the downhole straddle tool such that the heating module located at the leading end of the heater is aligned with the second annular sealing means.

2. The assembly as defined in claim 1 wherein said heating modules are chemical heat sources.

3. A downhole chemical heater for use in the deployment of the downhole straddle tool of claim 1, wherein said heater comprises a first chemical heating module at a leading end of the heater and a second chemical heating module at a trailing end of the heater.

4. The tool as defined in claim 1 wherein one or more additional annular sealing means are provided at points along the length of the tubing.

5. A downhole straddle tool deployment assembly, said assembly comprising:

a downhole straddle tool comprising:

a length of tubing having an inner surface defining an internal cavity for fluid flow and having a first annular sealing means on an outer surface of said tubing at a leading end thereof;

a second annular sealing means mounted on said outer surface of said tubing at a trailing end thereof; and wherein said first and second annular sealing means are formed from a eutectic/bismuth based alloy that expands as it cools from a molten liquid state, such that, the alloy of each annular sealing means is melted to form a seal between said outer surface of said tubing and an inner surface of a surrounding gas or oil well tubing and wherein each of said annular sealing means comprise multiple component parts which combine to form the complete annulus when mounted on the tubing;

a heater having at least two separate heating modules, said heating modules being located at the leading end and the trailing end of the heater respectively; and wherein the heater is detachably mounted to the downhole straddle tool such that the heating module located at the leading end of the heater is aligned with the second annular sealing means.

6. A downhole chemical heater for use in the deployment of the downhole straddle tool of claim 5, wherein said heater comprises a first chemical heating module at a leading end of the heater and a second chemical heating module at a trailing end of the heater.

7. The tool as defined in claim 1 or 2 wherein each of said annular sealing means comprise multiple component parts which combine to form the complete annulus when mounted on the tubing.

* * * * *